US006041595A

United States Patent [19]

Halimi et al.

[11] Patent Number: 6,041,595

[45] Date of Patent: Mar. 28, 2000

[54] THERMAL INSULATION FOR THE EXHAUST MANIFOLD FOR REDUCING PASSIVE FORMATION OF $NO_X$ AND REDUCTION OF UNBURNED HYDROCARBONS IN THE EXHAUST GAS

[75] Inventors: Edward M. Halimi, Montecito; Leland M. Burke, Santa Barbara County, both of Calif.

[73] Assignee: Turbodyne Systems, Inc., Carpinteria, Calif.

[21] Appl. No.: 08/782,567

[22] Filed: Jan. 10, 1997

[51] Int. Cl.[7] ..... F01N 7/10

[52] U.S. Cl. ..... 60/323; 60/280; 60/320; 60/612

[58] Field of Search ..... 60/323, 274, 320, 60/280, 123, 612

[56] References Cited

U.S. PATENT DOCUMENTS

| | | | |
|---|---|---|---|
| 437,078 | 10/1890 | Buchi | 60/612 |
| 4,168,610 | 9/1979 | Engquist | 60/322 |
| 4,182,122 | 1/1980 | Stratton | 60/322 |
| 5,018,661 | 5/1991 | Cyb | 228/176 |
| 5,552,196 | 9/1996 | Haselkorn | 428/34.5 |

*Primary Examiner*—Christopher Verdier
*Assistant Examiner*—Binh Tran
*Attorney, Agent, or Firm*—Brinks Hofer Gilson & Lione

[57] ABSTRACT

An insulation blanket is applied around the exhaust manifold of an internal combustion engine to maintain higher exhaust gas temperature in the manifold, thus both to enhance oxidation of unburned hydrocarbons therein and also to reduce ambient air contact with the exterior of the manifold to reduce passive formation of $NO_x$.

19 Claims, 2 Drawing Sheets

THERMAL INSULATION FOR THE EXHAUST MANIFOLD FOR REDUCING PASSIVE FORMATION OF $NO_X$ AND REDUCTION OF UNBURNED HYDROCARBONS IN THE EXHAUST GAS

FIELD OF THE INVENTION

This invention is directed to the use of a jacket wrapped around the exhaust manifold of a lean running internal combustion engine to maintain high temperature in the exhaust gases for oxidation of the remaining fuel therein. In addition, the hot otherwise-uninsulated exhaust manifold causes nitrogen oxidation in the external ambient air so that the manifold covering also reduces the passive formation of $NO_x$.

BACKGROUND OF THE INVENTION

In recent years, the air/fuel ratio for an internal combustion engine, and particularly a gasoline engine, has been run lean to avoid unburned hydrocarbons in the exhaust. This is not so much required for fuel economy, but to minimize the unburned hydrocarbons discharged from the exhaust into the atmosphere. In some jurisdictions, it has been found that, even with lean running of the engine, the exhaust products included a significant amount of hydrocarbons. To overcome this, after-burning catalytic converters have been applied.

In other jurisdictions, after-burning catalytic converters have not been used because such converters require that the engines run on unleaded fuel in order to avoid poisoning of the catalytic converter. Thus, an entire new fuel supply system must be created in order to achieve after-burning with catalytic converters.

It has been found that a hot exhaust manifold, which runs hotter in today's lean running engines, causes formation of $NO_x$ in the ambient air around the exterior of the manifold. There is still need both to reduce the unburned hydrocarbons in the exhaust gases of gasoline engines and to reduce the passive formation of $NO_x$ in the ambient air surrounding the hot exhaust manifold.

SUMMARY OF THE INVENTION

In order to aid in the understanding of this invention, it can be stated in essentially summary form that it is directed to the use of insulation on the exhaust manifold of the engine to reduce heat outflow and thus maintain exhaust gas temperatures at a higher level to enhance oxidation in the exhaust manifold.

It is, thus, a purpose and advantage of this invention to increase exhaust gas temperature in the exhaust manifold by insulating it and thus decreasing the heat transfer rate from the exhaust gas through the metal of the manifold to the outside air. The increased exhaust gas temperature promotes increased oxidation of unburned hydrocarbons, thus lowering total hydrocarbon emissions.

It is a further purpose and advantage of this invention to reduce the temperature of the surface in contact with the ambient air to reduce passive formation of NOx.

It is another purpose and advantage of this invention is to provide an inexpensive and easily applied solution to the problem of reducing the unburned hydrocarbons in the exhaust of an internal combustion engine.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawing.

DESCRIPTION OF THE PREFERRED EMBODIMENT

Figure 1:
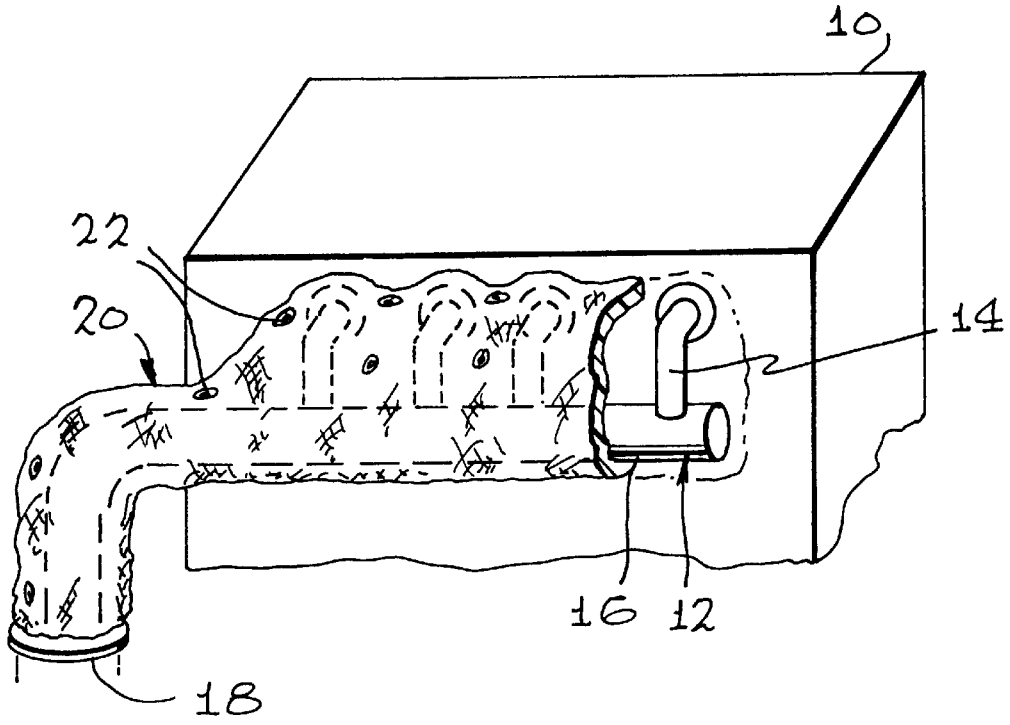
FIG. 1 is a perspective view of the exhaust manifold of an internal combustion engine on a non-turbocharged engine with an insulation layer thereon, with the insulation layer partly broken away.

FIG. 1 shows a non-turbocharged internal combustion engine 10. The internal combustion engine has the usual parts, such as air and fuel supply, valves and pistons, ignition means in the case of a gasoline engine, and a manifold to discharge the exhaust. The exhaust manifold is generally indicated at 12. The exhaust manifold has a connection adjacent each exhaust valve. The connection tube 14 is one of four such connections in the engine shown. The connection tubes from the cylinders join together in the main manifold tube 16. The manifold tube has a flange 18 at its exhaust end for connection to a muffler and an exhaust pipe, as is conventional.

The insulation blanket 20 consists of a flexible high-temperature covering, such as ATD Corporation's Thermsulate 5000, which is applied over the exhaust manifold 12. The blanket 20 is trimmed as necessary to enclose the manifold. It is then fastened by means of pop rivets 22 and washers. The blanket 20 substantially lowers the heat transfer rate from the exhaust manifold 12 to the engine compartment environment, thus increasing the exhaust gas temperature in exhaust manifold 12. The blanket 20 also increases the rate of the temperature rise of the exhaust manifold after starting the engine, when hydrocarbons are at their highest level. This helps further to reduce hydrocarbons. The use of a blanket on the exhaust manifold is useful in gasoline fueled engine, gas fueled engines, and in diesel fueled engines.

Figure 2:
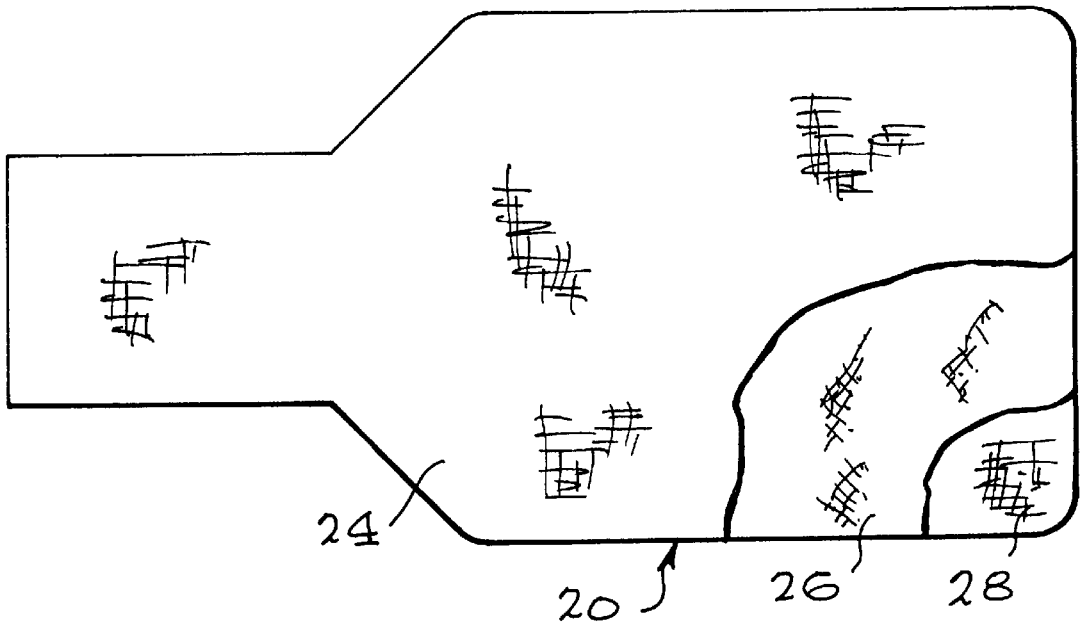
FIG. 2 is a plan view of an insulation blanket shown in FIG. 1 as being wrapped around an exhaust manifold for the insulation thereof.

FIG. 2 shows the insulation blanket 20 in its laid-out flat position before installation. It is supplied shaped or can be trimmed to shape to wrap around a specific exhaust manifold 12. In FIG. 2, the insulation blanket is shown from the inside before it is wrapped around the manifold. It has an inside layer 24, which is heat-resistant, flexible and which is preferably shiny to reflect radiant heat. A metallic coating or layer which withstands temperatures in the 1100 degree F. range is suitable. Outside of the layer 24 is the mass insulation layer 26. Fiberglass batting is suitable. The outer layer 28 is suitable to hold the fiberglass mass insulation and the rest of the structure in position. It may be fiberglass cloth or the like. As previously stated, the blanket is wrapped around the manifold, and the overlapping free edges are secured together by means of pop rivets 22 with washers, or the like.

Due to several factors, including time and flow constraints, the combustion of hydrocarbons in an internal combustion engine is never complete. There is always a small amount of fuel and lubricating oil which leaves the engine through the exhaust unoxidized. The levels of these unburned (unoxidized) hydrocarbons in the exhaust can reach up to 0.3 percent. However, if there is any oxygen in the exhaust and the exhaust gases are hot enough and there is sufficient residence time, then oxidation can continue. Normally, up to 40 percent of these unburned hydrocarbons are oxidized in the exhaust ports and manifolds. However, this oxidation reaction is critically dependent on the temperature and residence time of the exhaust gases in these areas. For instance, for oxidation to occur, the exhaust gases need to remain at 1100 degrees F. or more for a minimum of 0.05 seconds. This condition is difficult to achieve in the exhaust manifold. Insulation blanket 20 is shown as wrapped around the manifold tube and the connection tubes to totally enclose as much as practicable of the exhaust system of the engine from the exhaust port on the engine block to the connection flange. The purpose of the insulation blanket 20 is to increase the exhaust gas temperature in the exhaust manifold by insulating it and thus decreasing the heat transfer from the exhaust to the outside air. The increased exhaust gas temperature will, in turn, promote increased oxidation of unburned hydrocarbons, thus lowering total hydrocarbon emissions.

As engines are made to run more lean to improve fuel economy and to reduce the discharge of unburned hydrocarbons, the exhaust temperature runs higher. In engines running at full load, it is possible that the exhaust manifold becomes cherry red. This brings about another undesirable result. When air is raised to about 1000 degrees F., the nitrogen and oxygen therein react to produce nitrogen oxides (NOx). Thus, outside of the engine there is passive formation of nitrogen oxide merely by exposure of these hot engine parts to the air. The insulation blanket 20 not only maintains the internal temperature of the manifold sufficiently high to oxidize the unburned hydrocarbons, but also prevents the outside ambient air from coming into contact with the hot manifold to avoid the production of this passive formation of Nox at the exterior of the manifold.

Figure 3:
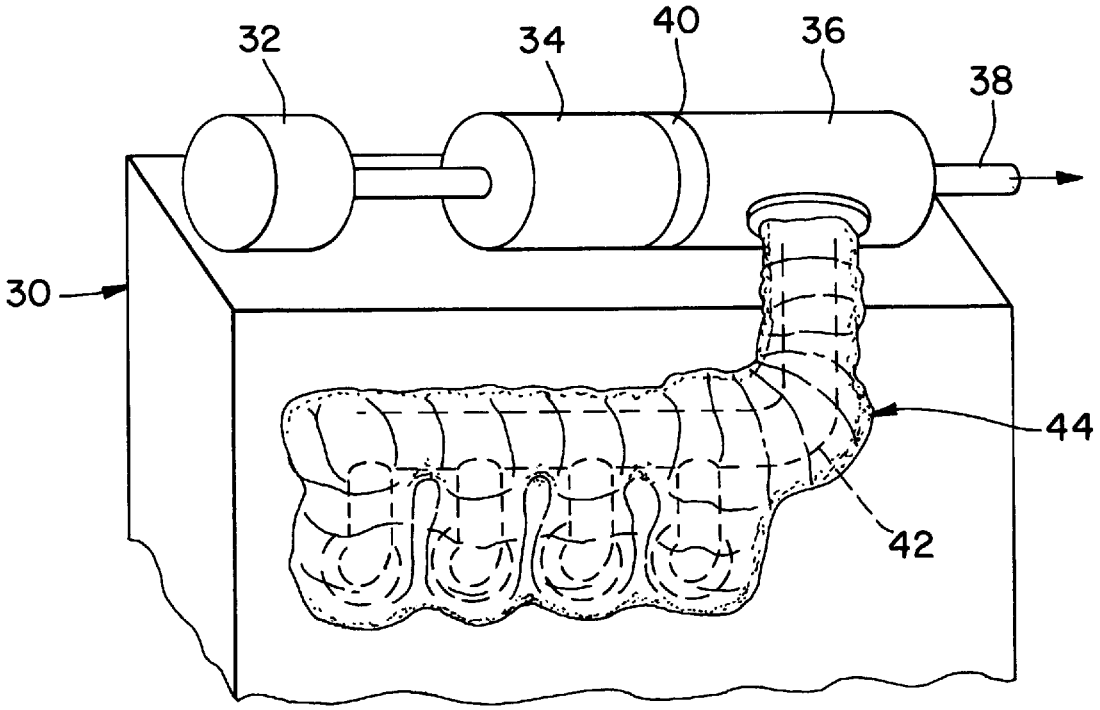
FIG. 3 is a perspective view of another style of insulation wrapped on the exhaust manifold of an internal combustion engine with the manifold feeding the exhaust gas-driven turbine which runs the engine air compressor on a turbocharged engine.

FIG. 3 shows a turbocharged internal combustion engine 30. It has an air intake 32, which is usually an air cleaner, and an air compressor 34, which delivers compressed air to the engine intake, whether it be a carburetor in a carbureted gasoline engine or the intake manifold of an injected gasoline or diesel engine. The air compressor is driven by exhaust gas turbine 36, which discharges exhaust gas to atmosphere out of exhaust pipe 38. The turbocompressor may be equipped with an electric motor 40 positioned therebetween which drives the compressor at low engine load so that adequate air is supplied during increasing load on the turbocharged internal combustion engine 30.

Exhaust gas is collected from the cylinder exhaust valves and is delivered through connecting tubes to exhaust manifold 42. The exhaust manifold is connected to the exhaust gas turbine, which receives the hot exhaust gas to expand the hot exhaust gas and discharge it from pipe 38.

Figure 4:
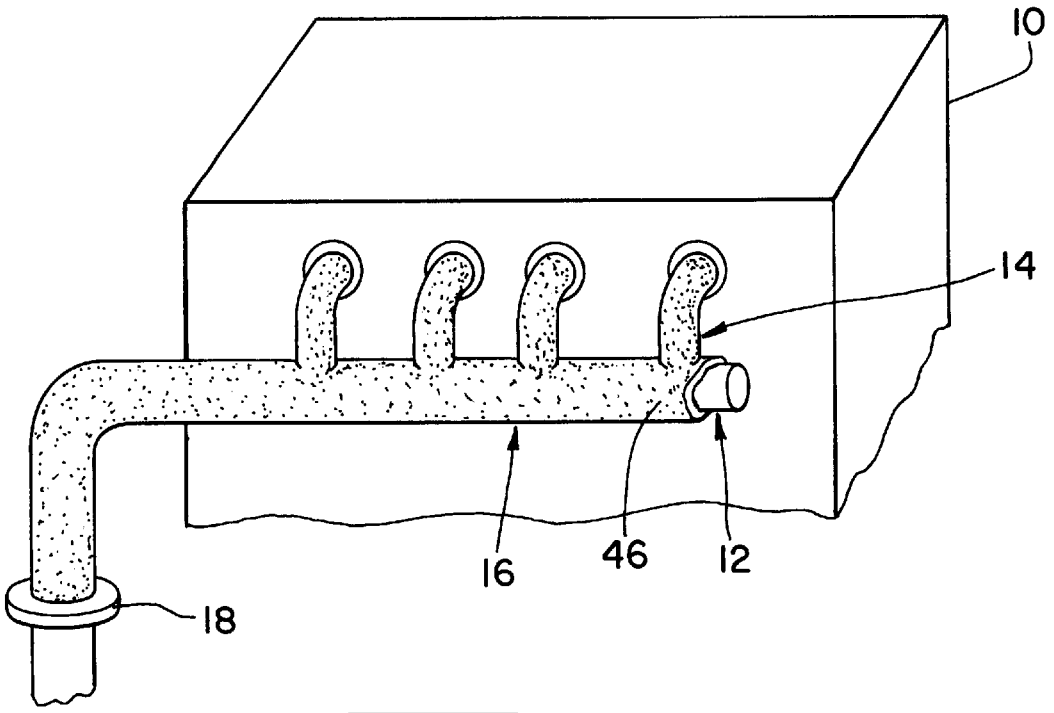
FIG. 4 is a perspective view of the exhaust manifold of an internal combustion engine on a non-turbocharged engine with a porous ceramic insulation, partially broken away.

The exhaust manifold 42 should be insulated for several reasons. Insulation wrap 44 is in the form of a tape or rope which has thermal insulating properties and which can be wrapped around the manifold and the connecting tubes thereto. Such a rope may be made of fiberglass. A tape of substantially rectangular cross section could be formed with a fiberglass body and fabric in the outer layers. Other ways of producing a suitable insulation layer on the exhaust gas manifold is to spray a ceramic coating thereon. After the spraying, the structure cures at room temperature and then bakes upon heating during use. This creates a porous ceramic structure of high temperature thermal insulating value, as shown at 46 in FIG. 4.

Another suitable structure is commercially available Thermo-Shield, which is available from Thermo-Tec Company. The interior fabric is a high silica fiber fabric with a metallized mirror finish. This provides excellent insulation against thermal transfer and also against the radiant heat of the exhaust manifold.

The reason for providing this protection to the exhaust manifold which delivers hot exhaust gas to the turbine is threefold. First, the delivering of higher temperature gas to the turbine increases the turbine efficiency. Second, maintaining higher temperature in the exhaust manifold enhances the oxidation of unburned hydrocarbons in the exhaust gas. Modern engines run lean so there is sufficient oxygen to permit this oxidation providing the time is sufficiently long and the temperature is sufficiently high. A third reason for insulating the manifold is to prevent the ambient air around the engine from contacting the hot manifold surface. This contact causes passive formation of NOx simply by oxidation of the nitrogen in the air when it is in contact with the hot exhaust manifold surface. Thus, these three conditions are improved by application of the insulation.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. Thermal insulation for reducing passive formation of NOx and reducing unburned hydrocarbons, comprising:

an internal combustion engine having an exhaust gas manifold, a thermal insulation blanket positioned on said exhaust gas manifold and retained thereon by fasteners penetrating the blanket to reduce heat loss from said exhaust gas manifold, so that the internal combustion engine exhaust gas temperature is operated at a higher level than in the absence of such insulation both to enhance hydrocarbon combustion in the exhaust gas in the manifold and also to inhibit ambient air from engaging on the exterior surface of said manifold so as to reduce the passive formation of NOx resulting from ambient air coming into contact with the exterior of the hot manifold.

2. The thermal insulation of claim 1 wherein said thermal insulation blanket includes a non-conductive insulation.

3. The thermal insulation of claim 1 wherein said thermal insulation blanket includes a radiant insulation.

4. The thermal insulation of claim 1 wherein said thermal insulation blanket includes both a non-conductive insulation and a radiant insulation.

5. The thermal insulation of claim 1 wherein said thermal insulation blanket comprises a multilayer blanketed insulation which is wrapped around said exhaust manifold and secured in place.

6. The thermal insulation of claim 1 wherein said fasteners are rivets passing through said blanket.

7. The thermal insulation of claim 1 wherein said thermal insulation blanket comprises an elongated flexible strand of thermal insulation material which is wrapped spirally around said exhaust manifold.

8. The thermal insulation of claim 1 wherein said thermal insulation blanket comprises a porous ceramic insulation.

9. The thermal insulation of claim 1 wherein said internal combustion engine has an exhaust gas-driven turbocharger thereon and said exhaust gas manifold is connected to said exhaust gas-driven turbocharger and said thermal insulation blanket extends to said exhaust gas-driven turbocharger to maintain a higher exhaust gas temperature into said turbocharger to increase power output of said turbocharger.

10. Thermal insulation for the exhaust manifold of an internal combustion engine, comprising:

said thermal insulation being configured to engage around the exhaust gas manifold of an internal combustion engine to maintain the internal temperature of the exhaust gas manifold at a higher level than if not insulated both to enhance combustion of unburned hydrocarbons in the exhaust gas and also to prevent ambient air from contacting the exterior of the exhaust gas manifold to reduce passive formation of NOx by air coming into contact with the exterior of the exhaust gas manifold.

11. The thermal insulation of claim 10 wherein said thermal insulation is a non-conductive insulation.

12. The thermal insulation of claim 10 wherein said insulation is a radiant insulation.

13. The thermal insulation of claim 10 wherein said thermal insulation is both a non-conductive insulation and a radiant insulation.

14. The thermal insulation of claim 10 wherein said insulation is in the form of a blanket wrapped around the exhaust manifold.

15. The thermal insulation of claim 10 wherein said insulation is elongated and is spirally wrapped around the exhaust manifold.

16. The thermal insulation of claim 10 wherein said thermal insulation is ceramic insulation molded to fit the exhaust manifold.

17. A method of both inhibiting the discharge of unburned hydrocarbons from the exhaust of an internal combustion engine and also inhibiting the production of passive formation of NOx by air contact with the exterior of the hot exhaust manifold of the internal combustion engine comprising the step of:

thermally insulating the exhaust manifold of the internal combustion engine by wrapping insulation around the exhaust gas manifold and securing it in place to maintain higher temperature levels within the exhaust manifold than if not insulated so as both to enhance combustion of hydrocarbons in the exhaust gas and also to inhibit ambient air from contact with the exterior of the hot exhaust manifold to reduce passive formation of NOx resulting from ambient air contact with the hot manifold surface.

18. The method of claim 17 further including the step of delivering the exhaust gas through the thermally insulated manifold to an exhaust gas turbine.

19. The method of both inhibiting the discharge of unburned hydrocarbons from the exhaust of an internal combustion engine and also inhibiting the production of passive formation of NOx by air contact with the exterior of the hot exhaust manifold of the internal combustion engine comprising the step of:

thermally insulating the exhaust manifold of the internal combustion engine by applying ceramic insulation to the exterior of the exhaust gas manifold to maintain higher temperature levels within the exhaust manifold than if not insulated so as both to enhance combustion of hydrocarbons in the exhaust gas and also to inhibit ambient air from contact with the exterior of the hot exhaust manifold to reduce passive formation of NOx resulting from ambient air contact with the hot manifold surface.

* * * * *